United States Patent [19]

Mainiero et al.

[11] Patent Number: 4,978,943

[45] Date of Patent: Dec. 18, 1990

[54] METHOD AND APPARATUS FOR MAKING A VIBRATION-RESPONSIVE INTRUSION DETECTION BARRIER

[75] Inventors: John W. Mainiero; Michael R. Mainiero, both of Sandy Hook, Conn.; Thomas J. Heinlein, Ronkonkoma, N.Y.

[73] Assignee: MRM Security Systems, Inc., Waterbury, Conn.

[21] Appl. No.: 452,227

[22] Filed: Dec. 18, 1989

Related U.S. Application Data

[63] Continuation-in-part of Ser. No. 274,414, Nov. 18, 1988, Pat. No. 4,906,975.

[51] Int. Cl.[5] ..... G08B 13/12

[52] U.S. Cl. ..... 340/566; 256/1; 340/541

[58] Field of Search ..... 340/566, 541; 256/1, 256/6, 8, 10

[56] References Cited

U.S. PATENT DOCUMENTS

| | | | |
|---|---|---|---|
| Re. 30,814 | 12/1981 | Mainiero | 72/294 |
| 2,908,484 | 10/1959 | Uhl | 256/8 |
| 3,010,701 | 11/1961 | Klemm | 256/8 |
| 3,463,455 | 8/1969 | Meckel | 256/8 |
| 3,763,482 | 10/1973 | Burney et al. | 340/564 |
| 3,947,835 | 3/1976 | Laymon | 340/566 |
| 3,956,743 | 5/1976 | Geiszler et al. | 340/538 |
| 4,028,925 | 6/1977 | Mainiero | 72/294 |
| 4,040,603 | 8/1977 | Mainiero | 256/8 |
| 4,365,239 | 12/1982 | Mongeon | 340/564 |
| 4,503,423 | 3/1985 | Mainiero et al. | 340/552 |
| 4,509,726 | 4/1985 | Boggs et al. | 256/8 |
| 4,680,573 | 7/1987 | Ciordinik et al. | 340/541 |
| 4,718,641 | 1/1988 | Mainiero | 256/8 |
| 4,760,295 | 7/1988 | Macalindin | 310/27 |
| 4,777,476 | 10/1988 | Dank | 340/541 |
| 4,818,972 | 4/1989 | Mainiero et al. | 340/566 |
| 4,829,286 | 5/1989 | Zvi | 340/541 |
| 4,906,975 | 3/1990 | Casella et al. | 340/566 |

OTHER PUBLICATIONS

*Intrusion Detection Systems* by Robert L. Barnard 1981 (pp. 71–74).

"Peristop" Brochure–Bigotec AG, Aaron, Switzerland.

"Guardwire 300 Series" Brochure; Printed in U.K.-Guardwire of Kingsfield Industrial Estate, Derby Road, Wirksworth, Derby DE4 4BG, England–Complete Brochure.

*Primary Examiner*—Herbert Goldstein

*Assistant Examiner*—Thomas J. Mullen, Jr.

*Attorney, Agent, or Firm*—Anthony J. Casella; Gerald E. Hespos

[57] ABSTRACT

A new and improved apparatus and process for continuously forming an intrusion detection barrier coil from a strip of barbed metal tape is provided. The apparatus includes a series of rollers for deforming the central portion of the barbed metal tape into a generally U-shaped configuration, as well as a dispenser for depositing an elastomeric filler material into the U-shaped tape, and a mechanism for feeding a continuous length of vibration-sensitive electrical cable in the elongated, U-shaped tape. Thereafter, the composite assembly of U-shaped barbed tape, elastomeric and electrical cable is continuously forced through a set of opposed rollers so as to roll form the U-shaped section into a generally circular, closed configuration. The composite structure is then bent by a series of offset rollers in a generally horizontal plane to form a helical coil of intrusion detection barbed tape. The subject process is performed in a continuous manner as the strip of barbed tape is advanced through a roll forming station to define the U-shaped central portion of the tape, through the stations wherein the elastomeric filler material and vibration-sensitive cable are fed into the U-shaped central portion of the barbed tape, through the roll forming station wherein the cable and filler material are encased within the barbed tape, and through the edge bending station wherein the composite barbed tape is formed into a helical coil.

25 Claims, 9 Drawing Sheets

METHOD AND APPARATUS FOR MAKING A VIBRATION-RESPONSIVE INTRUSION DETECTION BARRIER

CROSS-REFERENCE TO RELATED APPLICATION

The subject application is a continuation-in-part of U.S. application Ser. No. 274,414, filed Nov. 18, 1988, now U.S. Pat. No. 4,906,975, issued Mar. 6, 1990, by Anthony J. Casella, John W. Mainiero, Michael R. Mainiero, and Anthony R. Zagami, entitled VIBRATION-RESPONSIVE INTRUSION DETECTION BARRIER, and assigned to the assignee of the subject application.

BACKGROUND OF THE INVENTION

Helical barbed tape is widely employed to define an elongated antipersonnel barrier that may be mounted on the ground, at the base of a fence or at the top of a supporting structure. The typical helical barbed tape comprises an elongated helically formed central support from which spaced apart clusters of barbs extend. Each cluster of barbs typically comprises a total of four barbs, with a first pair of barbs extending from a root on one side of the central support and a second pair of barbs extending from a second root on the opposite side of the central support. Each barb is an elongated generally flat member having opposed converging edges which intersect at a very sharp point. The barbs on opposed sides of the central supporting portion may be offset relative to the central support. An early version of a helical barbed tape of this general type is shown in U.S. Pat. No. 3,463,455 which issued to Meckel. Helical barbed tapes of the general type shown in U.S. Pat. No. 3,463,455 have received very substantial commercial success in view of their exceptional performance as an antipersonnel barrier.

Several improvements to the original Meckel barbed tape configuration have been made in recent years. In particular, double coil barbed tape barriers have been developed comprising an outer coil defining a helix having a first pitch and an inner coil defining a helix having a second pitch. The inner coil has been suspended generally centrally within the outer coil by a plurality of multistrand twisted cables extending therebetween. The use of inner and outer coils defining different respective pitches creates a substantially enhanced antipersonnel barrier. In particular, an intruder attempting to move between adjacent loops of the outer coil is likely to be stopped by the inner coil.

Another attempt to improve the basic structure of Meckel's U.S. Pat. No. 3,463,455 is shown in U.S. Pat. No. 4,503,423 which issued to Joseph J. Mainiero et al on Mar. 5, 1985. In particular, U.S. Pat. No. 4,503,423 shows a single coil structure wherein adjacent loops in the coil are welded to one another at a plurality of spaced apart locations about each loop. The weldment between adjacent turns on the helical barbed tape is intended to continuously maintain opposed major surfaces of adjacent turns of the coil in abutting face-to-face surface contact to prevent longitudinal, radial or pivotal movement of adjacent turns relative to one another at the attachment points. The rigid permanent weldment of adjacent coils at a plurality of such attachment points defines a barrier much like the old concertina barrier which is intended to prevent intruders from slipping between adjacent coils.

Many helical barbed tape products include a helically extending reinforcing wire about which the central helical support of the barbed tape is wrapped. An early version of a barbed tape product of this general type is shown in U.S. Pat. No. 2,908,484 which issued to Uhl on Oct. 13, 1959. The typical barbed tape product of this general type is manufactured by first wrapping a longitudinally extending barbed tape around the reinforcing wire, and then forming the combined tape and reinforcing wire into a helical configuration.

Several other improvements to helical barbed tape antipersonnel barriers have recently been made. For example, U.S. Pat. No. 4,718,641 which issued to Michael R. Mainiero on Jan. 12, 1988 and which is assigned to the assignee of the subject application is directed to a helical barbed tape with reinforced barbs. The reinforcements formed in the barbs, as shown in U.S. Pat. No. 4,718,641, substantially increase the strength of the barbs, and thereby enable the use of a thinner gauge metal with no negative effects on the performance of the barbed tape. U.S. Pat. No. 4,718,641 also shows that a reinforcing wire can be used in combination with the barbed tape with reinforced barbs. The reinforcing wire provides further support for the central supporting portion of the barbed tape, thereby further ensuring the specified performance of the product even with a thinner gauge metal material for the tape.

The intrusion prevention art further includes electronic detection devices. In particular, it has been considered desirable to combine the physical barriers provided by helical barbed tape with an electronic detection means such that an attempt to breach the physical barrier will be electronically detected. The typical breach that should be protected against should include attempts to pass between coils, to cut the helical barbed tape and/or to crush the barrier with wooden planks, vehicles or the like.

One attempt to combine electronic intrusion detection devices with a barbed tape is shown in the above referenced U.S. Pat. No. 4,503,423. In particular, U.S. Pat. No. 4,503,423 attempts to use the helical barbed tape as a wave guide. A microwave transmitter is disposed at one end of the elongated helical barbed tape shown in U.S. Pat. No. 4,503,423 and directs a signal generally centrally through the helix defined by the barbed tape. A receiver is disposed at the other end of the barbed tape to receive the microwave signals from the transmitter. Variations in the received microwave signal may be indicative of an intrusion attempt.

Another prior art attempt to combine intrusion detection into an antipersonnel barrier is shown in U.S. Pat. No. 4,680,573 which issued to Ciordinik et al. on July 14, 1987. Ciordinik shows a single coil barbed tape similar to the above referenced Uhl structure. However, the reinforcing wire shown in the single coil of U.S. Pat. No. 4,680,573 includes an electrical or optical conductor. The signal carried by the electrical or optical conductor will be varied or broken if the barbed tape or barbed wire is cut or crushed. Although the apparatus shown in U.S. Pat. No. 4,680,573 may be effective for detecting certain types of breaches to the antipersonnel barrier, it will be ineffective for detecting any type of breach that does not cut or substantially crush the wire.

The prior art also includes the combination of a standard chain link or barbed wire fence in combination with a linear length of coaxial cable transducer extending along the length of the fence and capable of producing an alarm when an intrusion or compromise of the fence is attempted. This prior art teaching is shown, for example, in U.S. Pat. No. 3,763,482 which issued to Burney et al. on Oct. 2, 1973. The apparatus shown in U.S. Pat. No. 3,763,482 includes a coaxial cable with a dielectric filler comprising a radially polarized electret which develops and transmits a signal along the cable in response to deformations of the cable at any point along its length. In particular, the cable shown in U.S. Pat. No. 3,763,482 may be clamped to a chain link or barbed wire fence in a generally linear disposition to generate an electrical signal in response to an attempt by an intruder to climb or cut the fence.

Still another prior art system is marketed under the trademark "PERISTOP" by Bigotec AG of Aaron, Switzerland, and comprises a galvanized hollow steel wire containing an insulated copper conductor. The "PERISTOP" wire may be installed inside a conventional barbed tape concertina. The "PERISTOP" apparatus is similar to the above referenced U.S. Pat. No. 4,680,573 to Ciordinik et al. in that it is responsive only to the destruction or cutting of the wire.

U S. Pat. No. 4,818,972 is a continuation-in-part of the above referenced U.S. Pat. No. 4,718,641 and was filed by the inventors herein and is assigned to the assignee of the subject invention. U.S. Pat. No. 4,818,972 shows the helical barbed tape with reinforced barbs and further including a central vibration-sensitive reinforcing cable, such as an electret cable, a piezoelectric cable or a vibration-sensitive geophone transducer cable. A general discussion of vibration-sensitive electret coaxial cables, geophone transducer cables or piezoelectric transducer cables is provided in *Intrusion Detection Systems Principles of Operation and Application* by Robert L. Barnard which was published in 1981 by Butterworth Incorporated of Woburn, Massachusetts.

Despite the desirable features found in certain of the above referenced helical barbed tape antipersonnel barriers and certain electronic detection systems, it is desired to provide significant advances in the combination of these two art areas. In particular, the prior art electronic intrusion detection systems generally did not perform adequately as an antipersonnel barrier, while most prior art helical barbed tapes did not provide adequate detection of attempts to breach the physical barrier. With the exception of the above referenced U.S. Pat. No. 4,818,972, the prior art attempts to combine intrusion detection with helical barbed tape antipersonnel barriers have been responsive to cuts in the helical barbed tape and/or complete crushing of the helical barbed tape, but not to most other attempts to breach the physical barrier. Some other prior art attempts to marry these two technologies, such as the wave guide in the above referenced U.S. Pat. No. 4,503,423, have provided structures that would perform under laboratory conditions, but which were impractical when applied in the field.

In view of the above, it is an object of the subject invention to provide an effective antipersonnel barrier that is operative to detect attempts to breach the physical barrier.

Another object of the subject invention is to provide an antipersonnel barrier that is responsive to cuts and crushing of the wire as well as any significant movement within the barrier.

It is an additional object of the subject invention to provide an intrusion detection system wherein an intrusion detection wire is physically protected by an array of antipersonnel barriers.

Still another object of the subject invention is to provide an antipersonnel barrier and intrusion detection system wherein the intrusion detection portions of the system are supported relative to the system for preventing false alarms.

Yet another object of the subject invention is to provide an antipersonnel barrier and intrusion detection system wherein the sensitivity of the intrusion detection system is readily adjustable.

It is a further object of the subject invention to provide an antipersonnel barrier that is easily and inexpensively manufactured and installed.

Another object of the subject invention is to provide an intrusion detection system wherein electronic components are protected from environmental moisture.

It is still a further object of the present invention to provide a new and improved apparatus for manufacturing, in a continuous manner, a vibration-responsive intrusion detection barrier.

It is another object of the present invention to provide a new and improved process for manufacturing, in a continuous process, a vibration-responsive intrusion detection barrier.

SUMMARY OF THE INVENTION

The subject invention is directed to a new and improved apparatus and process for continuously forming a helical barbed tape which comprises a vibration-sensitive cable as a central reinforcing wire. The vibration-sensitive cable may be one of the known types of cables, including electret coaxial cables, geophone transducer cables, piezoelectric transducer cables and others. The preferred vibration-sensitive cable, as explained in greater detail herein, employs linear induction means to sense vibrations. The vibration-sensitive cable is surrounded by the central supporting portion of the elongated helically formed barbed tape. The vibration-sensitive cable may be at least partly surrounded by a filler material disposed intermediate the cable and the central supporting portion of the helical barbed tape. The filler material may be a silicone or other such initially flowable material. The filler helps transmit vibrations to the cable and prevents the accumulation of water or corrosive environmental deposits between the vibration-sensitive cable and the helical barbed tape. In some environments, the accumulation of moisture or corrosives could cause a degradation of the product and/or its performance. The helical barbed tape with the vibration-sensitive cable therein may be used independently or may be attached to another structure, fence or barrier.

A preferred embodiment of the barrier of the subject invention is directed to a double coil helical barbed tape comprising an outer coil and an inner coil supported generally centrally within the outer coil. The inner coil comprises the vibration-sensitive cable as explained above. The inner coil may define a pitch which is greater than the pitch defined by the outer coil. Additionally, the inner coil may define a helix generated in the opposite direction from the helix of the outer coil.

The outer coil preferably is defined by a helical barbed tape having a generally flat or slightly arched central supporting portion from which spaced apart clusters of barbs extend. Thus, the central supporting portion of the outer coil need not be wrapped around a reinforcing wire. The pitch of the outer coil may be controlled by spacer wires and/or by connecting means for generally holding adjacent coils in proximity to one another at a plurality of locations about each loop. In particular, the connecting means between adjacent loops may define a substantially rigid connection, such as welding, or mechanical means for providing a less rigid connection and/or a controlled amount of movement at selected points between adjacent loops.

The inner helical barbed tape with the vibration-sensitive cable securely mounted therein may be supported relative to the outer coil of helical tape by a plurality of strap means extending in generally radial directions between the inner and outer barbed tapes. The strap means may be welded to both the inner and outer barbed tapes or mechanically connected to at least one of the inner and outer helical barbed tapes. The strap means or other such means supporting the inner helical barbed tape within the outer helical barbed tape may also define the connection means between adjacent loops of the outer helical barbed tape.

The apparatus of the subject invention may further comprise electrical signal processing means for identifying vibration-related signals generated by the vibration-sensitive cables within the helical barbed tape. The electrical means may be variable to adjust the sensitivity of the apparatus. The subject invention may further comprise alarm means for generating alarm signals in response to signals sensed by the vibration-sensitive cable. The alarm means may be operative to identify a particular location of a sensed vibration signal.

The subject invention is further directed to a method for continuously making a helical barbed tape with a vibration sensitive cable therein. The method comprises the step of forming an elongated channel in the blanked tape. A filler material is then urged into the channel in a metered amount. The vibration-sensitive cable is then laid in the channel and the channel is formed substantially around the cable, such that the cable is supported relative to the barbed tape by the filler. The filler is metered to substantially fill all voids and to enhance the transmission of vibrations from the tape to the cable. The method steps may be carried out simultaneously at a plurality of spaced apart locations to define a continuous method. The method of the subject invention may further comprise the step of continuously bending the cable in a horizontal plane so as to form the vibration-sensitive cable into a helical configuration.

Still further, the subject invention provides a new and improved apparatus for continuously manufacturing a vibration-sensitive cable. The apparatus preferably includes a power supply for simultaneously driving a series of rollers for forming an elongated channel in a strip of metal tape that has been blanked to form barbs along the length thereof. The elongated central portion of the tape is formed to have a generally U-shaped cross-section in the central portion thereof. The apparatus also includes a dispensing means for dispensing a controlled amount of elastomeric material into the U-shaped channel of the barbed tape, as well as a vibration-sensitive cable supply station for feeding a continuous length of cable into the U-shaped channel portion of the tape. The apparatus also includes additional roller means for roll forming the central portion of the metal tape about the vibration-sensitive cable and the elastomeric material to form a continuous structure. The latter is then driven through an additional series of rollers of the subject apparatus so as to bend the composite cable/tape structure in a generally horizontal plane and into a helical coil configuration. The subject apparatus may include an additional station for scoring the blanked metal tape at selected locations across the width thereof to facilitate removal of the metal tape from the vibration-sensitive cable preparatory to providing electrical connectors at the opposite ends of the vibration-sensitive barrier coil.

DETAILED DESCRIPTION OF THE PREFERRED EMBODIMENTS

Figure 1:
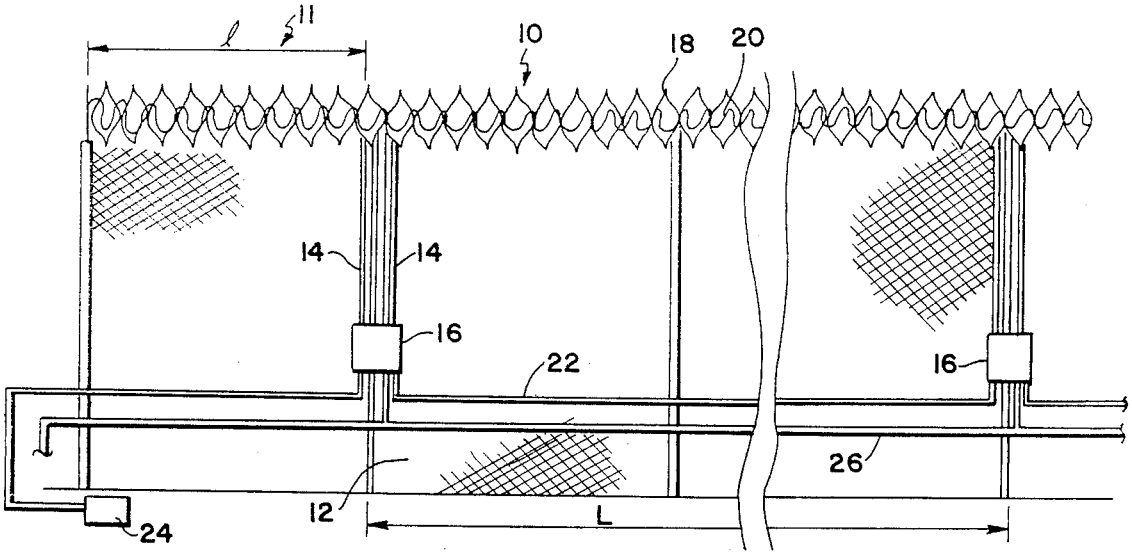
FIG. 1 is a front plan view of a fence to which an intrusion detection barrier in accordance with the subject invention is mounted.

The intrusion detection barrier of the subject invention is illustrated in FIGS. 1–4 and is identified generally by the numeral 10. In particular, the intrusion detection barrier 10, as shown in FIG. 1, is mounted to the top portion of a chain link fence 12. Lead-in cables 14 extend between the intrusion detection barrier 10 and signal processor 16. The processor 16 is generally operative to receive, process and transmit signals corresponding to an intrusion or attempted intrusion relative to the intrusion detection barrier 10. The signal processor 16 preferably is powered by a twelve volt DC power supply with a maximum loading of one watt. Power supplies and electronic controls for the signal processor 16 preferably are shielded from the sensing cable in the intrusion detection barrier 10 to minimize the possible effects of EMI between the power and signal systems.

The processor 16 includes means for calibrating and adjusting: the system sensitivity; the number of counts required above the selected threshold before one intrusion event is deemed to have occurred; the number of events that must occur before an alarm condition is declared; and the length of time that must expire before the first event discard occurs. The processor 16 provides independent alarm and tamper relay outputs. Relays are normally open so that any system failure causes an alarm condition. The tamper relay activates if interference with the signal processor 16 or the intrusion detection barrier 10 occurs. A tamper condition may also cause an audible tone to be sounded through an audio monitoring circuit. The signal processor 16 preferably is housed in a watertight enclosure manufactured from a rigid material such as 14-gauge steel with continuously welded seams. The cover preferably is furnished with a water-resistant gasket and quick-release latches.

FIG. 1 depicts two signal processors 16 being mounted to the fence 12. The typical spacing "L" between adjacent signal processors 16 preferably will be approximately one thousand feet. The intrusion detection barrier 10 extending between adjacent signal processors 16 typically will comprise a plurality of separate modules 11 which are electrically and mechanically connected to one another as explained in greater detail below. Each module defining the intrusion detection barrier 10 preferably will extend a length "1" of approximately fifty feet, with each fifty-foot module of the intrusion detection barrier 10 comprising an outer coil 18 having 101 loops per module and an inner coil 20 which preferably is of a different pitch and is generated in an opposite direction. In particular, the inner coil 20 preferably defines a greater pitch such that fewer loops of the inner coil 20 are disposed within each module defining the intrusion detection barrier 10.

Sensor cables 22 extend between adjacent signal processors 16 and to a central alarm processor 24. The central alarm processor 24 typically will be located in a central control station and will comprise a map display which is operative to visually identify the zone in which a sensed security breach occurs. The sensor 22 preferably is disposed within a rigid tube to discourage tampering, even though any such tampering attempt would generate an alarm. The system depicted in FIG. 1 further comprises electronic power lines 26 extending from a power source (not shown) to each of the respective signal processors 16. The power lines 26 are separated from the sensor cables 22 to further minimize the possible effects of induced EMI in the sensor cable upon the electronic processing circuitry.

Figure 2:
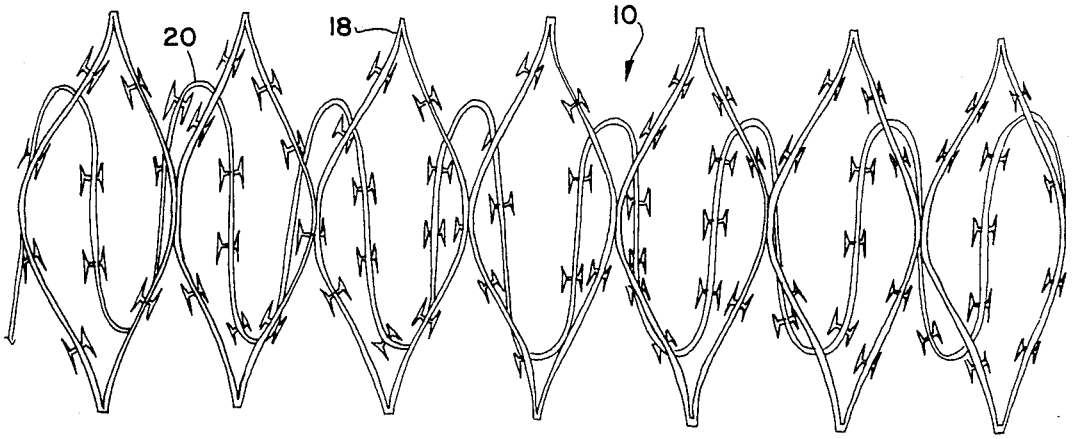
FIG. 2 is a front plan view of the intrusion detection barrier of the subject invention.
Figure 3:
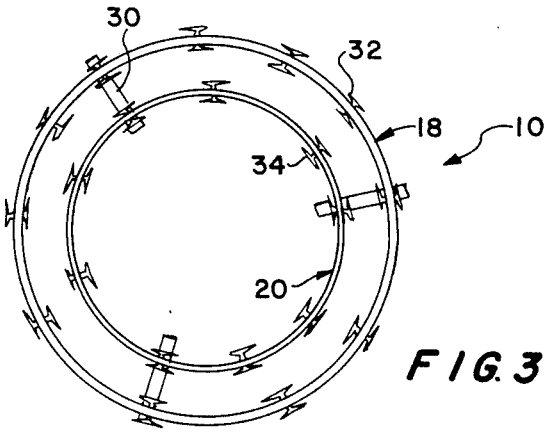
FIG. 3 is an end view of the intrusion detection barrier shown in FIG. 2.
Figure 4:
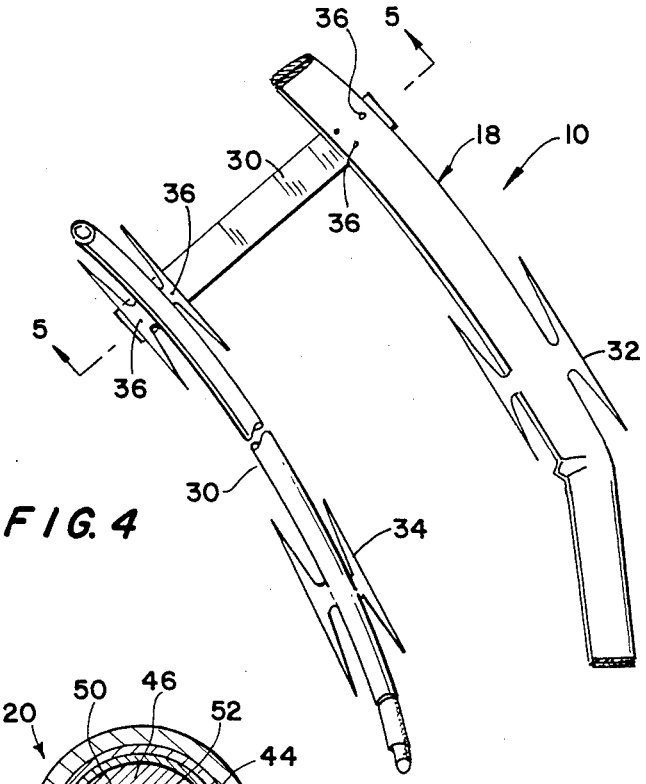
FIG. 4 is an elevational view showing a portion of the intrusion detection carrier of FIG. 3.
Figure 5:
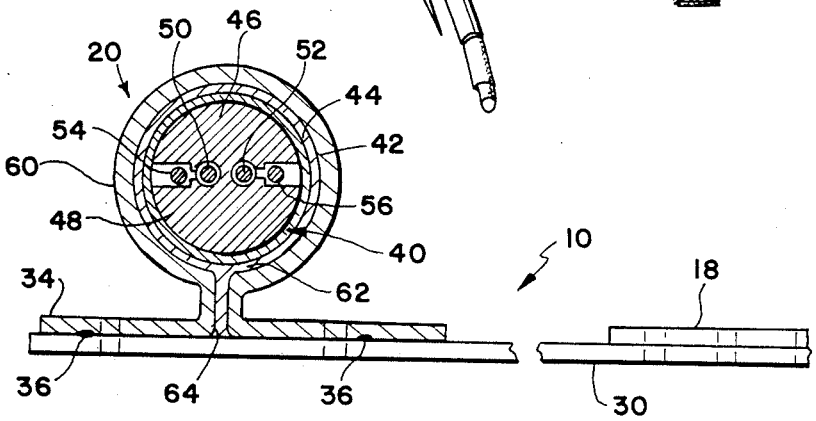
FIG. 5 is a cross-sectional view taken along line 5—5 in FIG. 4 and showing the vibration-sensitive cable incorporated into the inner helical barbed tape.
Figure 6:
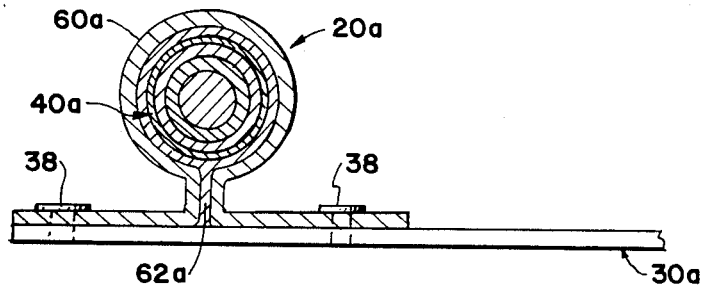
FIG. 6 is a cross-sectional view similar to FIG. 5, but showing an alternate vibration-sensitive cable incorporated into the inner helical barbed tape.

As shown more clearly in FIGS. 2 and 3, the inner coil 20 is supported generally centrally within the outer coil 18 by a plurality of generally radially extending connecting straps 30. The straps 30 define generally flat strips of metal which are aligned in generally radial directions and which are connected to both the outer coil 18 and the inner coil 20 at a plurality of locations about the circumferences of the respective outer and inner coils 18 and 20 and at spaced apart locations therealong. As depicted in FIGS. 3–5, the straps 30 are secured by weldments 36 to the respective outer and inner coils 18 and 20. Alternatively, the straps 30 may be connected by rivets 38 as shown in FIG. 6 or by other mechanical means as described and illustrated further below. The weldments 36 for securing the straps 30 to the outer coil 18 as shown in FIG. 5 may be at locations either in line with or between adjacent barb clusters 32. Preferably, as shown in FIG. 4, the strap 30 is secured to the outer coil 18 at locations thereon intermediate adjacent barb clusters 32. However, as shown most clearly in FIG. 4 to ensure an adequate surface to which the strap 30 may be affixed, and to ensure that weldments do not damage the vibration-sensitive cable within the inner coil 20, the strap 30 preferably is welded at the barb clusters 34 on the inner coil 20 rather than at locations between barb clusters 34.

The flat straps 30 supporting the inner coil 20 within the outer coil 18 efficiently transmit vibrations from the outer coil 18 to the inner coil 20 carrying the vibration-sensitive cable therein. In particular, the vibrations associated with even a slight contact against the outer coil 18 will be readily transmitted by straps 30 to the vibration-sensitive cable within the inner coil 20, thereby corresponding to a signal which can generate an alarm depending on the parameters established by the signal processors 16 and the central processor 24. The flat straps 30 have been found to be much more effective in transmitting vibrations than other connections, such as standard round cables. The greater effectiveness is believed to be attributable to the fact that round cables are more likely to dampen vibrations by twisting, stretching or the like. In contrast, the flat straps 30 shown in FIGS. 2–6 are extremely efficient in transmitting vibrations and exhibit a very small tendency to dampen these vibrations.

The vibration-sensitive cable incorporated into the center coil 20 may take any of a plurality of forms, including but not limited to geophone transducers, piezoelectric cables and coaxial electret cables. The preferred assembly, however, as depicted in FIG. 5, employs a vibration-sensitive cable 40 which comprises an outer insulating sheath 42, a metallic screening 44 disposed interiorly relative to the outer sheath 42 and a pair of opposed generally semicylindrical flexible magnetic cores 46 and 48. A pair of balanced conductor wires 50 and 52 are fixedly mounted in generally central positions relative to the magnetic cores 46 and 48. However, inductor wires 54 and 56 are mounted generally parallel to the conductor wires 50 and 52 and on opposite sides thereof. The inductor wires 54 and 56 are free to move in an air gap between the opposed flexible magnetic cores 46 and 48. The movement of the inductor wires 54 and 56 relative to the magnetic cores 46 and 48 and relative to the fixed conductor wires 50 and 52 is operative to generate a detectable signal. Even minor vibrations of the inner coil 30 will cause a movement of the inductor wires 54 and 56 sufficient to generate a signal. The vibration-sensitive cable 40 may be a GUARDWIRE 300 Series cable which is manufactured by Guardwire of Derby, England.

The entire cable 40 is securely retained within the central supporting portion 60 of the inner coil 20. In particular, the inner coil 20 is formed from an initially planar strip of metal which is blanked to define barb clusters 34 and then formed around the cable 40. An elastomeric filler material 62, such as silicone, is inserted into the space intermediate the formed supporting portion 60 of the inner coil 20 and the vibration-sensitive cable 40. The elastomeric material may be inserted in a generally flowable form as part of the forming of the support portion 60 and prior to placement of the cable 40 therein. The support portion 60 is then completely closed around the vibration-sensitive cable 40, such that the filler 62 is urged substantially entirely around the cable 40. Excess elastomer filler material 62 may be flushed or otherwise removed from external areas of the inner coil 20 prior to curing of the initially flowable elastomeric filler material 62. The elastomeric filler material 62 is disposed to lie generally between the cable 40 and the generally open portion 64 of the inner coil 20 adjacent the barb cluster 34 thereof. Elastomeric filler material 62 also preferably is urged into the space between the arcuate portion of the support 60 and the vibration-sensitive cable 40. The elastomeric filler material 62 functions to prevent water or corrosive materials from seeping into the area between the inner coil support portion 60 and the cable 40. Liquids such as water could freeze and expand within the small gaps between the cable 40 and the inner coil support 60 thereby causing damage to the cable 40 or the support 60 of the inner coil 20 and/or generating false signals. In addition to preventing the entry of liquids, the filler material has been found to enhance the transmission of vibrations to the cable 40. In particular, by filling all voids, any movement of the inner coil 20 will necessarily be transmitted to the cable 40.

FIG. 6 shows an inner coil **20*a* connected to a strap 30*a*. The inner coil 20*a* comprises a vibration-sensitive coaxial electret cable 40*a* which is retained within the generally cylindrical central supporting portion 60*a* of the barbed tape 20*a*. An elastomeric filler material 62*a* is disposed intermediate the coaxial electret cable 40*a* and the central supporting portion 60*a* of the inner coil 20*a*. As with the previously described embodiment, vibrations are transmitted through the strap 30*a* to the inner coil 20*a*. The coaxial electret cable 40*a* is operative to sense the vibrations transmitted through the strap 30*a*** and generate an appropriate alarm signal.

Figure 7:
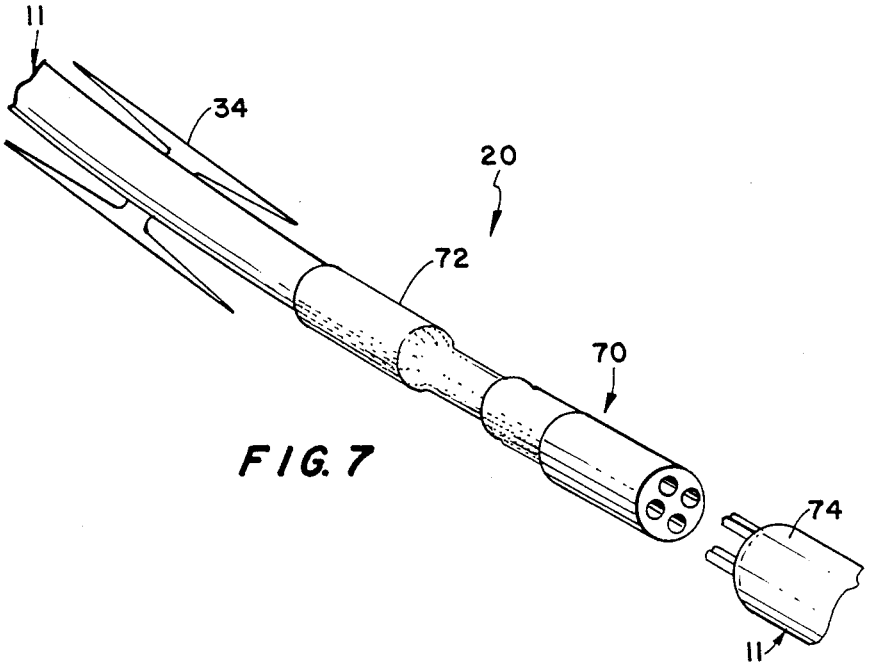
FIG. 7 is a perspective view showing an end of the helical barbed tape for electrically connecting the vibration-sensitive cable therein to another signal transmitting cable.

As noted above, a plurality of intrusion detection barrier modules 11 are interconnected to define the continuous intrusion detection barrier 10. To facilitate handling and installation of each intrusion detection module 11, the overall extended length thereof generally will be limited to approximately fifty feet. A plurality of the extended fifty-foot long modules will be mechanically interconnected at the outer coils 18 thereof and both electrically and mechanically interconnected at the inner coils 20. In particular, the barbed tape of the inner coil preferably will be scored at a location approximately two inches from each opposed end, prior to wrapping the barbed tape of the inner coil 20 around the cable 40 thereof. After the barbed tape of the inner coil 20 has been formed around the cable 40, the extreme axial ends will be flexed sufficiently to break the tape at the score and permit the extreme end of the tape to be removed from the cable 40. The cable 40 is then terminated to an electrical connector 70 as shown in FIG. 7. The interconnection of the cable within the inner coil 20 and the connector 70 preferably is rendered splashproof by an elastomeric or heat shrinkable sheath 72 which will closely conform to the inner coil 20 and the connector 70 for preventing environmental or water-related damage to the system. A mateable connector 74 is similarly connected to the opposed end of each module 11 defining inner coil 20. Thus, opposed ends of the inner coils 20 in adjacent modules 11 can be mechanically and electrically interconnected by merely interengaging the electrical connectors 70 and 74 of two adjacent inner coils 20.

Figure 8:
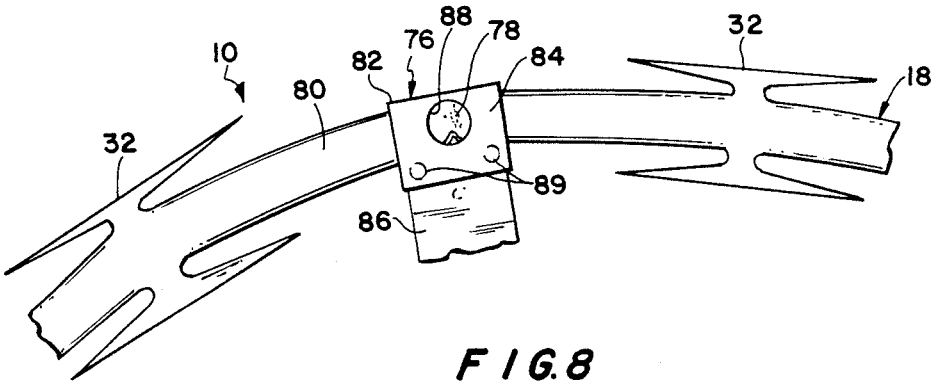
FIG. 8 is a top plan view of a strap mounted to the outer coil of helical barbed tape.

As noted above, adjacent loops of the outer coil 18 may be mechanically connected to one another to create a concertina-like structure. It is known to connect adjacent loops of the outer coil 18 together by welding. However, the welding of the adjacent loops of the outer coil 18 is a labor intensive process, with the possibility of the associated heat causing a local weakening or damage to the outer coil 18. Also, as noted above, the subject apparatus provides generally flat straps for supporting the inner coil 20 within the outer coil 18. FIG. 8 shows the use of mechanical clips 76 that can be used for holding adjacent loops of the outer coil 18 in generally close proximity to one another to create the concertina effect. In particular, the bending of the outer coil 18 into the helical configuration creates periodic folds 78 in the central supporting portion 80 of the outer coil 18. The folds 78 extend away from the generally arched central portion 78 between adjacent barb clusters 32. FIG. 8 depicts a clip 76 which is folded about a score line 82 to define opposed flaps 84 and 86. The flap 84 includes a punched hole 88 extended therethrough and dimensioned to engage the fold 78 in the barbed tape 18. The flap 86 includes an identical hole (not shown) to enable a tight nesting of adjacent loops of the outer coil 18 during storage. The opposed portions 84 and 86 may be folded about the barbed tape 18 such that the aperture 88 engages the fold 78. The opposed portions 84 and 86 of the clip 76 may be connected to one another by mechanical means or weldments 89 for holding adjacent loops of the outer coil 18 to one another at a plurality of locations about the perimeter of the outer coil 18. At selected locations, the portion 86 of the clip 80 may define an elongated strap which extends a sufficient radial distance inwardly to permit secure engagement with the inner coil for supporting the inner coil within the outer coil 18.

Figure 9:
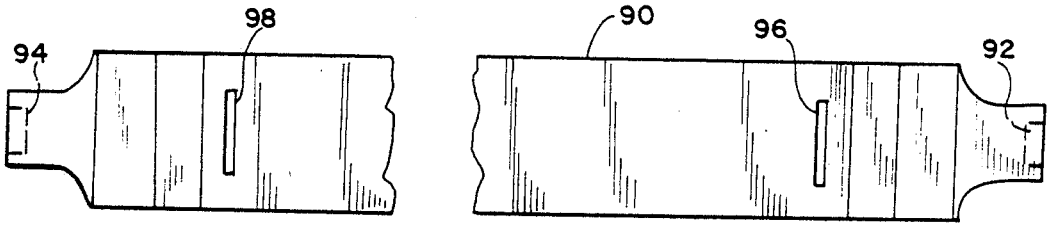
FIG. 9 is a top plan view of an alternate strap for supporting the inner helical barbed tape within the outer helical barbed tape.
Figure 10:
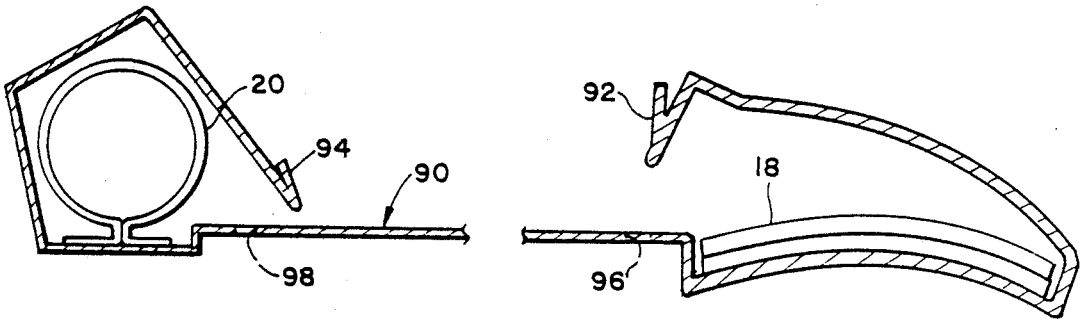
FIG. 10 is a cross-sectional view of the alternate strap being mounted to the inner and outer helical barbed tape.
Figure 11:
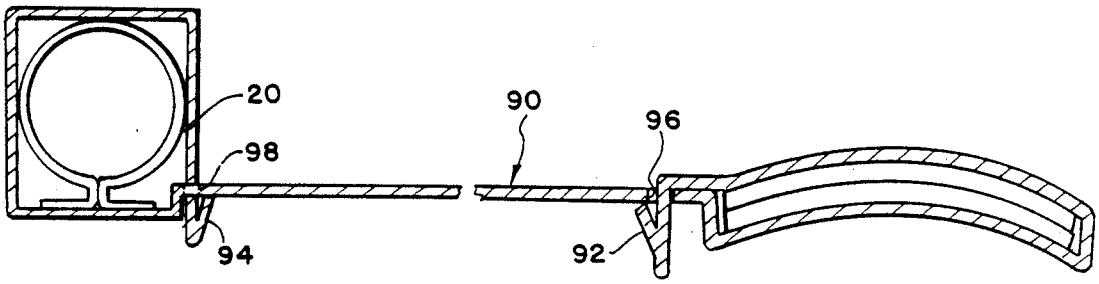
FIG. 11 a cross-sectional view showing the alternate strap in a fully mounted condition.

FIGS. 9–11 show one particular embodiment of a strap 90 relying completely upon mechanical connection means which enable the strap 90 to mechanically support the inner coil 20 within the outer coil 18. In particular, the strap 90 is formed to include deflectable locking tangs 92 and 94 generally adjacent each opposed end thereof. The strap 90 further comprises locking apertures 96 and 98 disposed intermediate the deflectable locking tangs 92 and 94 thereof, and a plurality of score lines defining locations about which the strap 90 can be bent. As shown most clearly in FIGS. 10 and 11, the strap 90 can be formed about both the outer and inner coils 18 and 20. The locking engagement of the tang 92 in the locking aperture 96 of the strap 90 will securely retain the strap 90 to a pair of adjacent loops of the outer coil 18, thereby simultaneously holding the adjacent loops of the outer coil 18 in close proximity to one another for achieving the desired concertina configuration. In a similar manner, the locking tang 94 can be inserted into the aperture 98, with the portions therebetween securely engaging the inner coil 20. Thus, the inner coil 20 will be securely supported generally centrally within the outer coil 18 by the strap 90. The mechanical connection of the strap 90 to the outer and inner coils 18 and 20 can be readily carried out with automated or manual tools.

Figure 12:
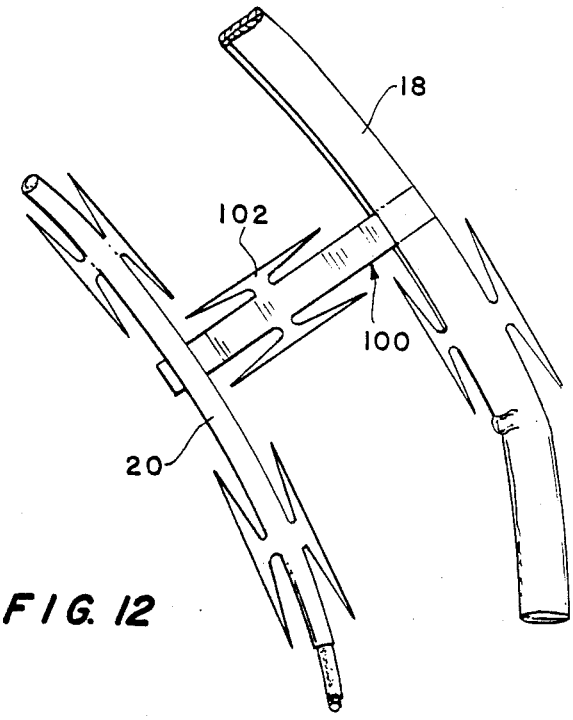
FIG. 12 is an elevational view similar to FIG. 4 but showing an alternative strap.

As depicted above, the strap 30 or 90 was a generally planar structure with longitudinally extending parallel sides. FIG. 12 shows an alternate strap embodiment 100 for supporting the inner coil 20 within the outer coil 18. The strap 100 differs from the straps 30 and 90 described above in that it is provided with a cluster 102 of offset barbs. The strap 100 performs the same supporting function of the straps 30 and 90 described above. Additionally, the strap 100 may be connected to the outer and inner coils 18 and 20 by welding or by purely mechanical interconnection as explained above. However, the cluster of barbs 102 provides an additional measure of protection for preventing any attempted breach of the intrusion detection barrier 10 or any attempt to tamper with the cables disposed within the inner coil 20.

Figure 13:
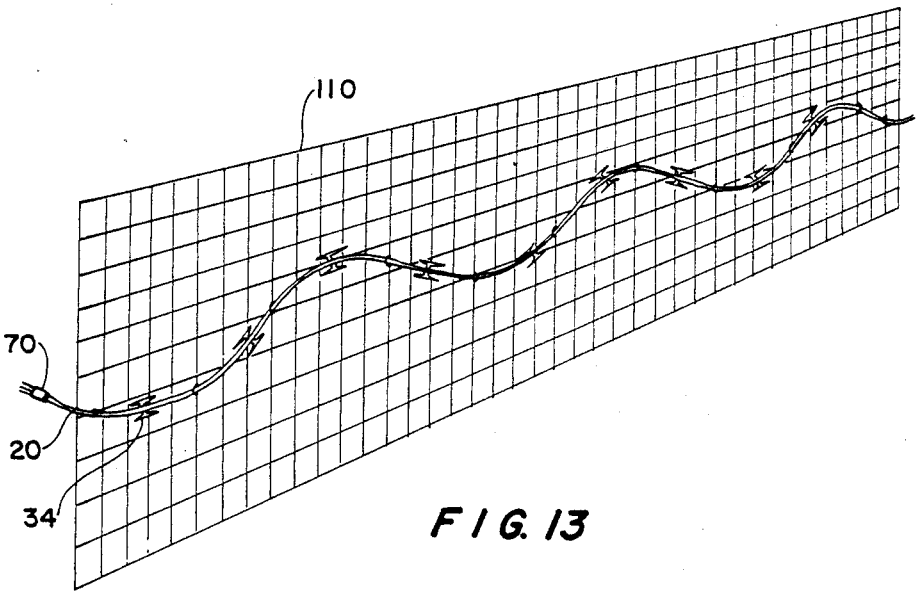
FIG. 13 is a perspective view of an alternate embodiment of an intrusion detection barrier.

FIG. 13 shows coil 20 described and illustrated above mounted to a fence 110. The fence 110 is depicted as being of a turkey-wire mesh construction. However, chicken wire, chain link or other support structures would be acceptable.

Figure 14:
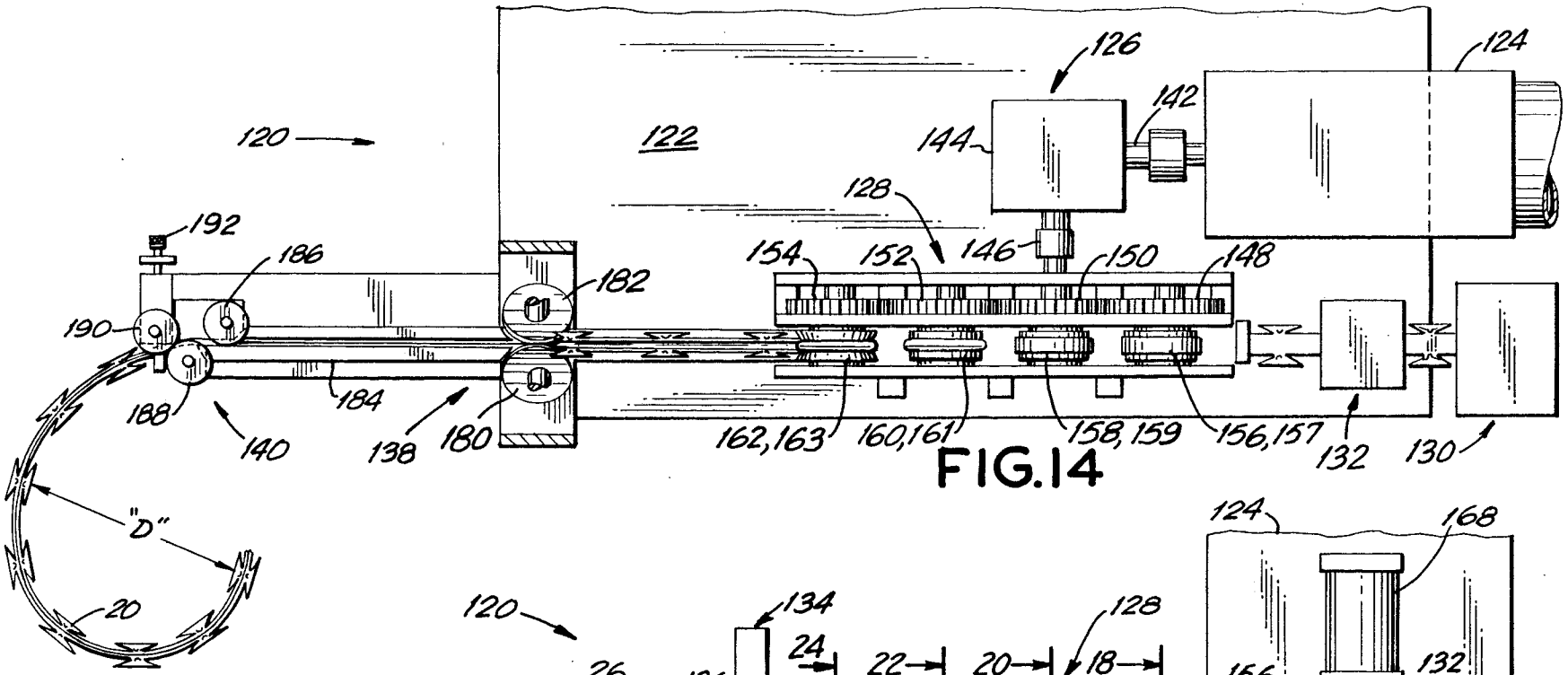
FIG. 14 is a top plan view, partially in section, of the new and improved apparatus of the subject invention.
Figure 15:
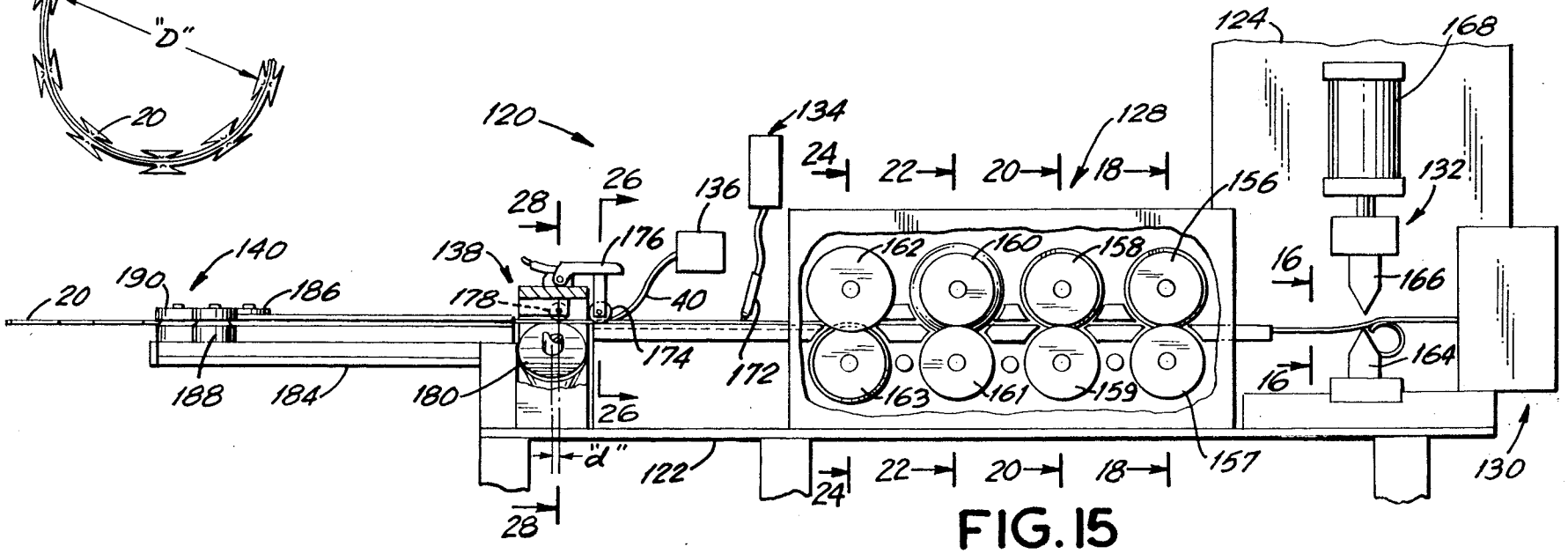
FIG. 15 is an elevational view, partially in section, of the new and improved apparatus of the subject invention.

FIGS. 14 and 15 illustrate the apparatus of the subject invention for continuously manufacturing the intrusion detection barrier inner coil 20. The new and improved apparatus is generally designated by the numeral 120, and basically comprises a support 122, a power supply 124 which is connected via drive means 126 to a roller forming assembly 128, a metallic barbed tape supply means 130, a scoring station 132, a dispensing means 134 for providing elastomeric filler material 62, a supply station 136 for providing the vibration-sensitive electrical cable 40, a roll forming station designated 138, and a bend station designated by the numeral 140. The power supply 124 is supported on the platform 122 and is connected by the drive means 126 including shaft 142 to a gear box 144 that, in turn, is connected by shaft 146 to a series of gears, designated by numerals 148–154. In turn, the gears 148–154 respectively drive opposed sets of rollers 156–157, 158–159, 160–161, and 162–163 forming a portion of the roll forming assembly 128.

Figure 17:
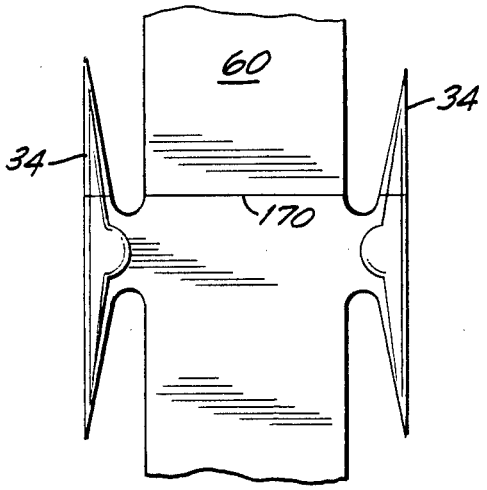
FIG. 17 is a plan view of the barbed metal tape of FIG. 16.
Figure 16:
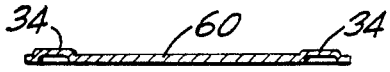
FIG. 16 is a cross-sectional view of the barbed metal tape taken along line 16—16 in FIG. 15.

The barbed tape supply station 130 provides a continuous strip of metallic barbed tape that is blanked so as to define the central support portion 60 of the barbed tape, as well as barb clusters 34 extending along opposite edge portions thereof. In the operation of the subject apparatus, the barbed tape is processed from the right hand portion toward the left hand portion of FIGS. 14 and 15. At station 130, a continuous strip of metallic barbed tape may be blanked preparatory to being formed into the vibration-sensitive center coil 20 or, alternatively, a strip of metallic barbed tape may be blanked using a conventional blanking machine, and the blank coil of tape would then be wound about a cassette or reel which would then be mounted at station 130 for feeding the continuous strip of blanked barbed tape to the apparatus 120. As the barbed tape progresses through the apparatus 120, it first progresses through the scoring station 130 which includes an anvil 164 and a vertically movable scoring punch 166 powered by hydraulic or electrical cylinder 168. At designated locations, the metallic barbed tape is scored to form a transverse score line 170 as shown in FIGS. 16 and 17. The score lines are formed at spaced locations along the length of the barbed tape in order to facilitate removal of the metallic tape from the resulting inner coil 20 for attachment of the electrical end connectors 70, as described hereinabove and shown in FIG. 7. The metallic barbed tape then progresses to the roller forming assembly 128 for progressively forming a U-shaped channel in the central support portion 60 of the barbed tape preparatory to placement of the vibration-sensitive cable 40 in the barbed tape.

Figure 19:
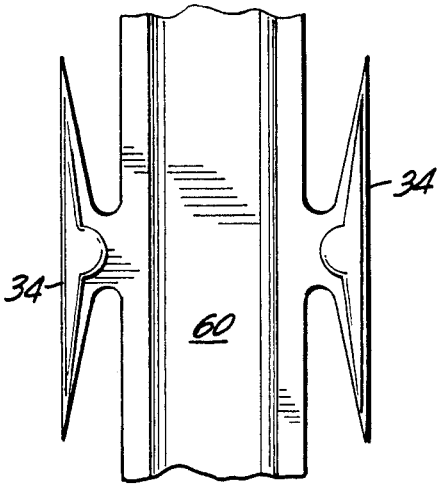
FIG. 19 is a plan view of the barbed metal tape of FIG. 18.
Figure 18:
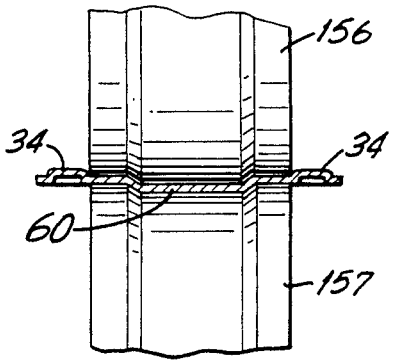
FIG. 18 is a cross-sectional view taken along line 18—18 in FIG. 15.
Figure 21:
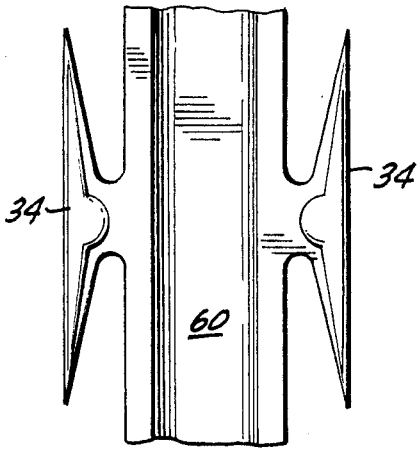
FIG. 21 is a plan view of the barbed metal tape of FIG. 20.
Figure 20:
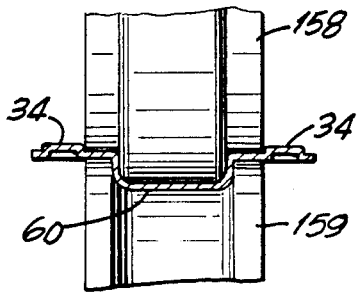
FIG. 20 is a cross-sectional view taken along line 20—20 in FIG. 15.
Figure 23:
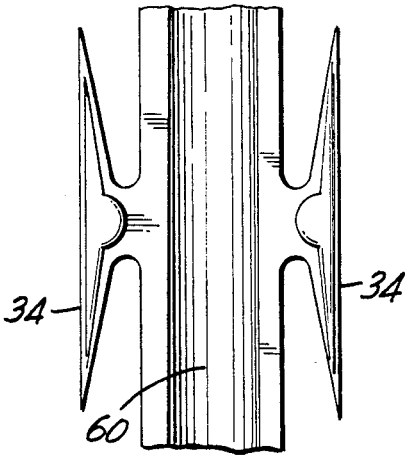
FIG. 23 is a plan view of the barbed metal tape of FIG. 22.
Figure 22:
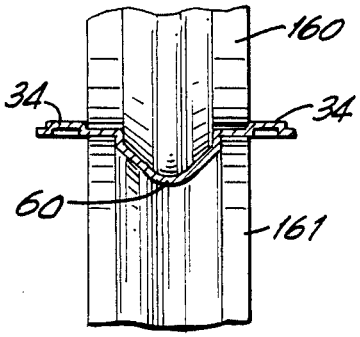
FIG. 22 is a cross-sectional view taken along line 22—22 in FIG. 15.
Figure 25:
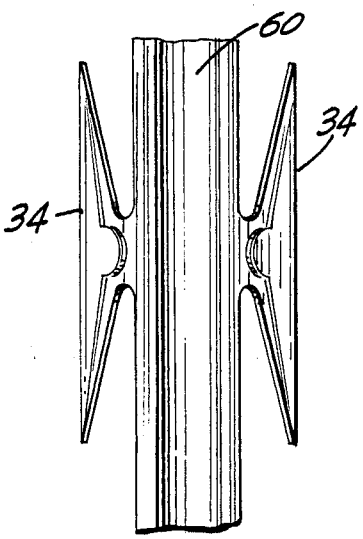
FIG. 25 is a plan view of the barbed metal tape of FIG. 24.

As shown in FIGS. 18 and 19, the first pair of cooperating rollers 156–157 are configured so as to nest together in order to roll form the central support 60 of the barbed tape to define a shallow U-shaped channel, as the rollers 156–157 are driven by the power supply 124 through the drive means 126 and gear 148. The barbed tape then progresses to the second set of rollers 158–159, as shown in FIGS. 20 and 21, and the latter rollers are configured and cooperate so as to further deform the central portion 60 of the barbed tape to define a deeper channel portion therein. As the barbed tape is driven through rollers 160–161, as shown in FIGS. 22 and 23, the central portion 60 of the metallic tape is roll formed into a deeper channel configuration, and in the final stage of the assembly 128, as shown in FIGS. 24 and 25, rollers 162–163 cooperate so as to roll form the central support portion 60 into a generally U-shaped configuration, and at the same time downwardly deflect the barb clusters 34, 34 to the configuration as shown in FIG. 24.

Figure 24:
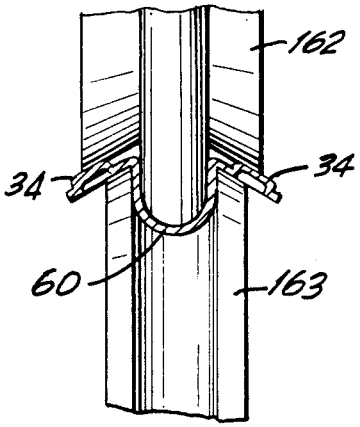
FIG. 24 is a cross-sectional view taken along line 24—24 in FIG. 15.
Figure 27:
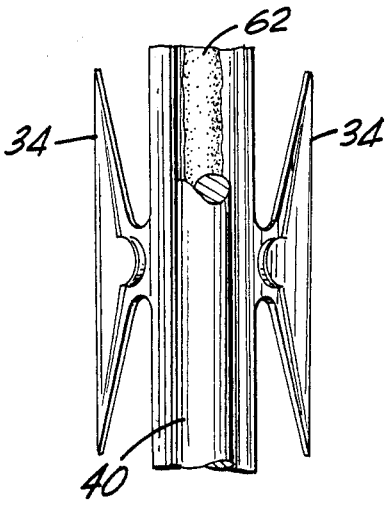
FIG. 27 is a plan view, partially in section, of barbed tape, elastomeric material, and vibration-sensitive cable shown in FIG. 26.
Figure 26:
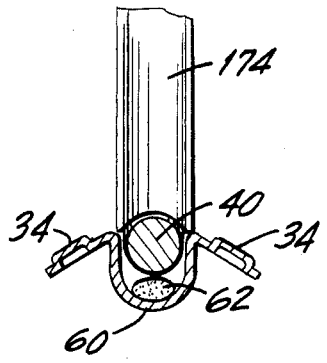
FIG. 26 is a cross-sectional view taken along line 26—26 in FIG. 15 and showing the elastomeric material and the vibration-sensitive cable disposed within the U-shaped channel of the barbed metal tape.
Figure 29:
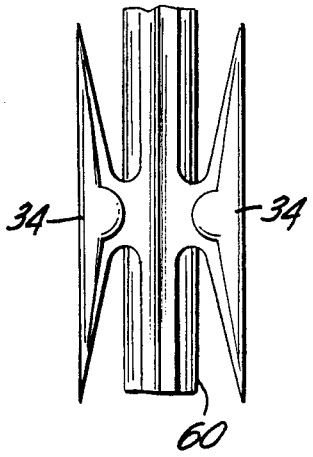
FIG. 29 is a plan view of the vibration-responsive, intrusion detection cable with barbed tape as in FIG. 28.
Figure 28:
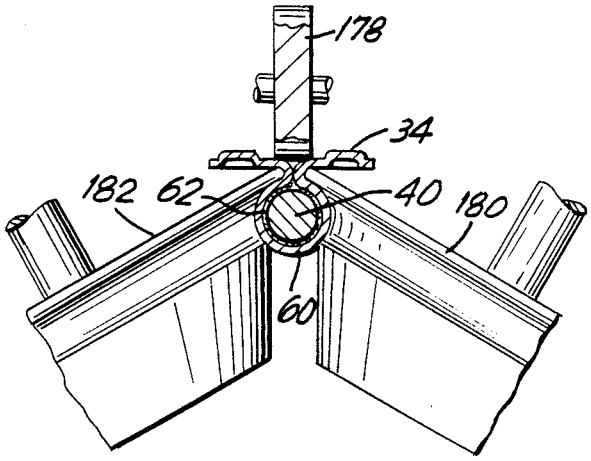
FIG. 28 is a cross-sectional view taken along line 28—28 in FIG. 15.

The strip of barbed tape of the configuration as shown in FIG. 24 is then continuously advanced to the dispensing station 134 at which position elastomeric filler material 62 is deposited via a feed nozzle 172 into the U-shaped portion of the barbed tape, as shown in FIGS. 26 and 27. Next, the vibration-responsive electrical cable 40 is continuously fed at station 136 into the U-shaped portion of the barbed tape on top of the elastomeric material 62, as shown in FIGS. 26 and 27. As the vibration-responsive electrical cable 40 is fed via the barbed tape, roller 174 which is mounted on a pivot arm mechanism 176 forces the electrical cable 40 deeper into the U-shaped channel in the central portion 60 of the barbed tape, so as to spread out the elastomeric material 62, after which the composite structure as shown in FIGS. 26 and 27 is advanced to the roll forming station 138. The latter includes top roller 178 and two opposed, inclined rollers 180 and 182 which have cooperating surfaces. The top roller 178 is disposed slightly upstream of the nip of the opposed rollers 180, 182 by a distance designated by the letter "d", and the composite effect of the three rollers 178, 180, 182 is to roll form the central support portion 60 of the barbed tape about the vibration-sensitive cable 40 and the elastomeric material 62 and, at the same time, cause the barb clusters 34 to assume a generally horizontal disposition, as shown in FIGS. 28 and 29. Preferably, the power means 124 operating through the rollers 156–163 provides sufficient momentum and driving force to the metallic barbed tape in order to advance the tape through the roll forming station 138, without requiring rollers 180 and 182 to be driven by a separate driving means.

Thereafter, the composite coil of the barbed tape and the vibration-sensitive cable, along with the intermediate elastomeric material is driven along a track portion 184 to the bending station 140. The bending station 140 includes three rollers 186, 188 and 190, the axes of which are positioned so as to cause a radial deflection and bending of the composite tape in a generally horizontal direction so as to result in the helical configuration of the inner coil 20. Roller 190 is preferably mounted for transverse movement relative to the longitudinal axis of the track 184 by micrometer adjustment device 192. Accordingly, adjustment of the device 192 causes displacement of the axis of the roller 190 relative to the axes of rollers 186 and 188 and a corresponding change in the resulting diameter "D" of the helical coil 20.

The apparatus 120 is operated in a continuous manner, whereby a continuous helical coil of an intrusion detection barrier 20 is obtained. During operation of the apparatus 120, the length of barbed tape within the apparatus 120 is simultaneously being subjected to the roll forming and bending operations set forth in detail above, and as a result there is manufactured a continuous helical coil which may be readily collected by suitable means as it leaves the apparatus 120.

In the new and improved process of the subject invention, a continuous strip of barbed tape is subjected to a metal-deforming operation so as to form the central support portion thereof into a generally U-shaped configuration, after which a vibration-sensitive cable and an elastomeric filler material are fed into said U-shaped portion of the cable. Next as part of the continuous process of the invention, the barbed tape is roll formed so as to encase the vibration-sensitive electrical cable and the elastomeric material within the metallic tape, after which the composite structure is continuously bent in a generally horizontal plane to form a helical structure.

In summary, an intrusion detection barrier is provided for providing both a superior antipersonnel barrier and for accurately detecting any attempted intrusion. The intrusion detection barrier comprises inner and outer coils defined by helical barbed tape. The inner coil may define a different pitch from the outer coil and may be generated in an opposite direction. Adjacent loops of the outer coil may be retained in proximity to one another to define a concertina-like construction. The inner coil is provided with a vibration-sensitive cable incorporated therein. In particular, the central supporting portion of the inner coil is formed around an electrical cable that is sensitive to vibrations. The inner coil preferably is supported relative to the outer coil by a plurality of generally flat metal straps extending therebetween. The straps are effective in transmitting vibrations in the outer coil to the inner coil, with the vibrations generating a signal through the vibration-sensitive cable retained with the inner coil. The straps may be welded or otherwise mechanically connected to both the outer and inner coils. The straps may further be provided with at least one cluster of barbs thereon for further security protection.

While the invention has been described relative to a preferred embodiment of apparatus and process, it is apparent that various changes may be made thereto without departing from the scope and spirit of the invention as defined by the appended claims.

We claim:

1. A method for continuously forming an intrusion detection barrier, said method comprising the steps of:

providing a barbed tape having an elongated central supporting portion and a plurality of barb clusters extending unitarily therefrom;

forming a longitudinally extending channel in said central supporting portion;

feeding an elastomeric filler material into the channel;

feeding an elastomeric filler placing an elongated vibration-sensitive cable in the channel; and forming the central supporting portion of the barbed tape around the vibration-sensitive cable and the filler material, whereby the filler material prevents accumulation of moisture between the cable and the barbed tape and enhances the transmission of vibrations to the cable, with the steps of forming the channel, feeding the filler, placing the cable in the channel and forming the central supporting portion around the cable being carried out substantially simultaneously at a plurality of spaced locations along the barbed tape.

2. A method for continuously forming an intrusion detection barrier as in claim 1 wherein said step of forming a longitudinally extending channel in said central supporting portion is performed in a sequence of operations which progressively enlarges the cross-sectional size of the channel.

3. A method for continuously forming an intrusion detection barrier as in claim wherein the longitudinally extending channel is formed in said central supporting portion by rolling the barbed tape between two cooperating rollers.

4. A method for continuously forming an intrusion detection barrier as in claim 3 wherein the barbed tape is successively rolled between a plurality of sets of cooperating rollers to progressively increase the cross-sectional size of the channel.

5. A method for continuously forming an intrusion detection barrier as in claim 1 including the step of transversely scoring the elongated central supporting portion of the barbed tape at longitudinally spaced locations to facilitate termination of the vibration-sensitive cable with electrical end connectors.

6. A method for continuously forming an intrusion detection barrier as in claim 1 including the further step of edge bending the formed barbed tape and vibration-sensitive cable in a generally horizontal plane to form a generally helical intrusion detection barrier.

7. A method for continuously forming an intrusion detection barrier as in claim 1 wherein said step of forming the central supporting portion of the barbed tape around the vibration-sensitive cable and the filler material is effected by roll forming the barbed tape using two opposed rollers.

8. A method for continuously forming an intrusion detection barrier as in claim 7 further including the step of forcing the vibration-sensitive cable into the filler material in the channel prior to the step of forming the central supporting portion of the barbed tape around the vibration-sensitive cable and the filler material.

9. A method for continuously forming a helical intrusion detection barrier, said method comprising the steps of:

providing a barbed tape having an elongated central supporting portion and a plurality of barbed clusters extending unitarily therefrom;

transversely scoring the elongated central supporting portion of the barbed tape at longitudinally spaced locations to facilitate termination of the helical intrusion detection barrier with electrical end connectors;

forming a longitudinally extending channel in said central supporting portion;

feeding a controlled amount of an initially flowable filler material into the channel;

placing an elongated vibration-sensitive cable in the channel;

forming the central supporting portion of the barbed tape around the vibration-sensitive cable and the filler material; and edge bending the formed barbed tape and vibration-sensitive cable in a generally horizontal plane to form the helical intrusion detection barrier, with the steps of scoring the barbed tape, forming the channel, feeding the filler, placing the cable in the channel, forming the central supporting portion of the barbed tape around the vibration-sensitive cable and the filler material, and edge bending being carried out substantially simultaneously at a plurality of spaced locations along the barbed tape.

10. A method for continuously forming a helical intrusion detection barrier as in claim 9 wherein said step of forming a longitudinally extending channel in said central supporting portion is performed in a sequence of operations which progressively enlarges the cross-sectional size of the channel.

11. A method for continuously forming a helical intrusion detection barrier as in claim 9 wherein the longitudinally extending channel is formed in said central supporting portion by rolling the barbed tape between two cooperating rollers.

12. A method for continuously forming a helical intrusion detection barrier as in claim 11 wherein the barbed tape is successively rolled between a plurality of sets of cooperating rollers to progressively increase the cross-sectional size of the channel.

13. A method for continuously forming a helical intrusion detection barrier as in claim 9 wherein said step of forming the central supporting portion of the barbed tape around the vibration-sensitive cable and the filler material is effected by roll forming the barbed tape using two opposed rollers.

14. A method for continuously forming a helical intrusion detection barrier as in claim 13 further including the step of forcing the vibration-sensitive cable into the filler material in the channel prior to the step of forming the central supporting portion of the barbed tape around the vibration-sensitive cable and the filler material.

15. An apparatus for continuously forming a helical intrusion detection barrier including a vibration-sensitive electrical cable disposed within the central support portion of an elongated strip of metallic barbed tape comprising:

drive means;

first forming means connected to said drive means for forming a longitudinally extending channel along the central support portion of the elongated strip of metallic barbed tape;

dispensing means for dispensing an elastomeric filler material into said channel;

feeding means for inserting a continuous length of vibration-sensitive electrical cable in said channel of said metallic barbed tape;

second forming means for deforming said central portion of the metallic barbed tape so as to encase said vibration-sensitive cable therein; and edge forming means for bending the intrusion detection barrier in a generally horizontal plane to form the helical intrusion detection barrier, with the first and second forming means, the dispensing means, the feeding means, and the edge forming means operating substantially simultaneously at a plurality of spaced locations along the length of the metallic barbed tape.

16. An apparatus for continuously forming a helical intrusion detection as in claim 15 further including scoring means for transversely scoring the elongated central supporting portion of the barbed tape at longitudinally spaced locations to facilitate termination of the vibration-sensitive cable with electrical end connectors.

17. An apparatus for continuously forming a helical intrusion detection barrier as in claim 15 wherein said first forming means comprises a series of sets of cooperating rollers connected to said drive means for progressively enlarging the cross-sectional size of the channel formed in the central support portion of the elongated strip of metallic barbed tape.

18. An apparatus for continuously forming a helical intrusion detection barrier as in claim 15 wherein said second forming means comprises two opposed rollers, the axes of which are oppositely inclined to the vertical, with the nip of said rollers being disposed so as to encase said vibration-sensitive cable within the central portion of the metallic barbed tape.

19. An apparatus for continuously forming a helical intrusion detection barrier as in claim 15 further including roller means for forcing the vibration-sensitive electrical cable into the filler material in the channel of the central supporting portion of the barbed tape.

20. An apparatus for continuously forming a helical intrusion detection barrier as in claim 15 wherein said edge forming means comprises a plurality of rollers, one of which is transversely adjustable relative to the longitudinal axis of the intrusion detection barrier in order to control the diameter of the helical intrusion detection barrier.

21. An apparatus for continuously forming an intrusion detection barrier including a vibration-sensitive electrical cable disposed within the central support portion of an elongated strip of metallic barbed tape comprising:

drive means;

first forming means connected to said drive means for forming a longitudinally extending channel along the central support portion of the elongated strip of metallic barbed tape;

dispensing means for dispensing an elastomeric filler material into said channel;

feeding means for inserting a continuous length of vibration-sensitive electrical cable in said channel of said metallic barbed tape; and second forming means for deforming said central portion of the metallic barbed tape so as to encase said vibration-sensitive cable therein, with the first and second forming means, the dispensing means, and the feeding means operating substantially simultaneously at a plurality of spaced locations along the length of the metallic barbed tape.

22. An apparatus for continuously forming an intrusion detection barrier as in claim 21 further including scoring means for transversely scoring the elongated central supporting portion of the barbed tape at longitudinally spaced locations to facilitate termination of the vibration-sensitive cable with electrical end connectors.

23. An apparatus for continuously forming an intrusion detection barrier as in claim 21 where said first forming means comprises a plurality of sets of opposed rollers for progressively increasing the cross-sectional size of the channel in the central support portion of the elongated strip of metallic barbed tape.

24. An apparatus for continuously forming an intrusion detection barrier as in claim 22 wherein said scoring means comprises a fixed anvil and a movable anvil driven by a power cylinder, with said movable and fixed anvils being respectively disposed on opposite sides of the barbed tape.

25. An apparatus for continuously forming an intrusion detection barrier as in claim 23 wherein said first forming means comprises four sets of opposed rollers, with each of said rollers being connected via a gear train to the drive means for simultaneous operation thereof.

* * * * *